US006683518B2

(12) United States Patent
Motta

(10) Patent No.: US 6,683,518 B2
(45) Date of Patent: Jan. 27, 2004

(54) SURFACE MOUNT MOLDED RELAY PACKAGE AND METHOD OF MANUFACTURING SAME

(75) Inventor: James J. Motta, Cumberland, RI (US)

(73) Assignee: Kearney-National, Inc., New York, NY (US)

( * ) Notice: Subject to any disclaimer, the term of this patent is extended or adjusted under 35 U.S.C. 154(b) by 0 days.

(21) Appl. No.: 10/249,001

(22) Filed: Mar. 7, 2003

(65) Prior Publication Data

US 2003/0169138 A1 Sep. 11, 2003

Related U.S. Application Data

(60) Provisional application No. 60/362,856, filed on Mar. 8, 2002.

(51) Int. Cl.[7] ..... H01H 1/66
(52) U.S. Cl. ..... 335/151
(58) Field of Search ..... 336/84 R, 84 M, 336/84 C, 198, 205–208, 192; 335/151–154

(56) References Cited

U.S. PATENT DOCUMENTS 5,963,116 A * 10/1999 Endoh et al. ..... 335/151
6,008,708 A * 12/1999 Endoh et al. ..... 335/151
6,052,045 A * 4/2000 Martich ..... 335/151

* cited by examiner

*Primary Examiner*—Tuyen T. Nguyen
(74) *Attorney, Agent, or Firm*—Barlow, Joseph & Holmes, Ltd.

(57) ABSTRACT

The electromechanical device of the present invention is a low profile reed switch package for surface mounting on a printed circuit board. The reed device package includes a reed switch with two signal terminals emanating from opposing sides thereof. A leadframe is employed with signal conductors and ground conductors. The signal conductors are respectively attached to each of the signal terminals. A ground shield surrounds the body of the reed switch. The ground conductors are connected to the ground shield on a first side of the reed switch with the signal conductor on one side of the reed switch being positioned between the two ground conductors. Another pair of ground conductors are connected to the ground shield on the other side of the switch and are similarly positioned with the other signal conductor positioned therebetween. The reed switch device is overmolded with encapsulation material with the exception of the free ends of the signal and ground conductors which receive solder balls thereon for surface mount installation to a circuit board. After encapsulation, excess portions of the leadframe are trimmed away.

16 Claims, 9 Drawing Sheets

SURFACE MOUNT MOLDED RELAY PACKAGE AND METHOD OF MANUFACTURING SAME

CROSS REFERENCE TO RELATED APPLICATIONS

This application claims priority from Provisional Patent Application Ser. No. 60/362,856, filed Mar. 8, 2002.

BACKGROUND OF INVENTION

The present invention relates generally to switching devices. More specifically, the present invention relates to improved packaging and circuit integration for electromagnetic devices, such as reed switches and electromagnetic devices, such as reed relays, for switching high frequency signals. These relays are intended for applications in industries such as Automated Testing Equipment (ATE), where test signals having frequency ranges from DC to 12 GHz must be switched with minimum power loss and minimum pulse distortion.

Electromagnetic relays have been known in the electronics industry for many years. Such electromagnetic relays include the reed relay which incorporates a reed switch. A reed switch is a magnetically activated device that typically includes two flat contact tongues which are merged in a hermetically sealed glass tube filled with a protective inert gas or vacuum. The switch is operated by an externally generated magnetic field, either from a coil or a permanent magnet. When the external magnetic field is enabled, the overlapping contact tongue ends attract each other and ultimately come into contact to close the switch. When the magnetic field is removed, the contact tongues demagnetize and spring back to return to their rest positions, thus opening the switch.

Reed switches, actuated by a magnetic coil, are typically housed within a bobbin or spool-like member. A coil of wire is wrapped about the outside of the bobbin and connected to a source of electric current. The current flowing through the coil creates the desired magnetic field to actuate the reed switch within the bobbin housing. Some applications of reed devices require the switch to carry signals with frequencies in excess of 500 MHz. For these applications, a ground shield conductor, commonly made of copper or brass is disposed about the body of the reed switch. The ground shield conductor is commonly in a cylindrical configuration. The shield conductor resides between the reed switch and the bobbin housing to form a co-axial high frequency transmission system. This co-axial system includes the outer shield conductor and the switch lead signal conductor co-axially through the center of the reed switch. The ground shield conductor is employed to contain the signal through the switch conductor in order to maintain the desired impedance of the signal path.

Currently available reed devices are then incorporated into a given circuit environment by users. For application at higher frequencies, a reed switch device must be ideally configured to match as closely as possible the desired impedance requirements of the circuit in which it is installed.

Within a circuit environment, a co-axial arrangement is preferred throughout the entire environment to maintain circuit integrity and the desired matched impedance. As stated above, the body of a reed switch includes the necessary co-axial environment. In addition, the signal trace on the user's circuit board commonly includes a "wave guide" where two ground leads reside on opposing sides of the signal lead and in the same plane or a "strip line" where a ground plane resides below the plane of the signal conductor. These techniques properly employed provide a two-dimensional, controlled impedance environment which is acceptable for maintaining the desired impedance for proper circuit function.

However, the reed switch device must be physically packaged and electrically interconnected to a circuit board carrying a given circuit configuration. It is common to terminate the shield and signal terminals to a lead frame architecture and enclose the entire assembly in a dielectric material like plastic for manufacturing and packaging ease. The external portion of the leads may be formed in a gull-wing or "J" shape for surface mount capability. The signal leads or terminals exit out of the reed switch body and into the air in order to make the electrical interconnection to the circuit board. This transition of the signal leads from plastic dielectric to air creates an undesirable discontinuity of the protective co-axial environment found within the body of the switch itself. Such discontinuity creates inaccuracy and uncertainty in the impedance of the reed switch device. As a result, circuit designers must compensate for this problem by specifically designing their circuits to accommodate and anticipate the inherent problems associated with the discontinuity of the protective co-axial environment and the degradation of the rated impedance of the reed switch device.

For example, the circuit may be tuned to compensate for the discontinuity by adding parasitic inductance and capacitance. This method of discontinuity compensation is not preferred because it complicates and slows the design process and can degrade the integrity of the circuit. There is a demand to reduce the need to tune the circuit as described above. The prior art uses a structure of carefully designed vias, which are expensive and difficult to manufacture, to control the impedance from the relay to the board transition.

There have been many attempts in the prior art to solve the aforementioned problems associated with the packaging and the incorporation of reed switch devices into a circuit. For example, prior art reed switch devices typically include a printed circuit board substrate onto which the reed switch itself is installed. Circuit board traces are deposited on the surface of the printed circuit board to provide a wave guide to extend the co-axial environment of the relay from the reed switch itself down to the main circuit board into which the device package is installed. However, there are problems associated with the use of a printed circuit board as a substrate within an overmolded device package as well as manufacturing limitations.

Since it is commonly desired that the reed switch package be as small as possible, the use of a very thin printed circuit board is required. While a thin printed circuit board substrate has good RF transmission characteristics, it is less than ideal mechanically. The epoxy/fiberglass material of a typical printed circuit board is thin and fragile, and is subject to distortion or cracking under the heat and pressure stresses of the encapsulation process. Distortion of the leads can lead to misalignment of the solder balls when they are fastened to the product after molding. If the misalignment is severe, one or more relay balls can miss the solder pads on the user's circuit board when the relay is fastened, causing electrical discontinuities that require expensive rework.

The substrate solder pads are also fragile and are, therefore, easily damaged when the relay solder balls are reflow soldered to the substrate. A further disadvantage of solder pads is that they are flat; because of this, the solder balls can wander on them during attachment, causing further misalignment. After the relay is molded, solder balls are fixed to pads provided on the exposed external portions of the substrate traces. The solder balls melt when the relay is applied to the user's circuit board, providing the electrical connections to the reed switch, coaxial shield and coil. Since the circuit board substrate has a fibrous edge profile that is exposed at the exterior of the relay, it also provides a potential path for ingress of moisture during circuit board cleaning processes. Water ingress is highly undesirable, since it can lower the relay's insulation resistance. Also, the printed circuit board is relatively expensive compared to the total component cost for the entire product. Therefore, it is desired for this part to be removed from the construction.

In the prior art, there have been attempts to eliminate the use of printed circuit board substrates in electronic device packages. Many molded electronic packages use an internal metal leadframe skeleton to support internal components and transmit electrical signals in and out of the package. The leadframe supports the internal components during assembly, and is cut away after the product is molded leaving legs or pins that are used for external connections.

A metal leadframe could provide such features to obviate the need for a printed circuit board provided that it does not degrade the quality of the signals being transmitted through the relay. However, leadframes are generally not optimized for very high frequency signal transmission. At frequencies of several GHz and beyond, signals must be carried on special structures such as tuned striplines or waveguides to minimize losses. Known leadframe structures are not capable for accommodating such high frequency signals. In particular, known leadframe structures are not capable of meeting industry requirements for relays used for testing high speed memory and other semiconductors which is a loss of no more than half power (−3 dB) for signals up to 5 GHz ($5\times10^9$ Hz) which fall into the radio frequency (RF) band. The deficiencies in known leadframe capability will continue to be particularly inadequate in the future as the above requirement is likely to rise to 20 Ghz and beyond over the next few years.

In view of the foregoing, there is a demand for a reed switch device that includes a controlled impedance environment through the entire body of the package to the interconnection to a circuit. There is a particular demand for a reed switch device to be compact and of a low profile for installation into small spaces and for circuit board stacking. There is further a demand for reed switch devices that are of a surface mount configuration to optimize the high frequency of the performance of the system. Further, there is a demand for a reed switch device that can reduce the need to tune a circuit to compensate for an uncontrolled impedance environment. There is a further need for a reed relay package that is low in cost yet still robust and rugged in construction with the ability to transmit high frequency signals through a closed relay with minimum power loss.

SUMMARY OF INVENTION

The present invention preserves the advantages of prior art electromagnetic switch devices, such as reed relays. In addition, it provides new advantages not found in currently available switching devices and overcomes many disadvantages of such currently available devices.

The invention is generally directed to the novel and unique reed switch device with particular application in effectively interconnecting a reed switch device to a circuit on a circuit board in a low profile configuration. The reed switch package of the present invention enables the efficient and effective interconnection to a circuit board while being in an inexpensive construction.

The electromechanical device of the present invention mounts forms a low profile, board surface mountable reed relay. The reed device package includes a reed switch with two signal terminals emanating from opposing sides thereof. A leadframe is employed with signal conductors and ground conductors. The signal conductors are respectively attached to each of the signal terminals. A ground shield surrounds the body of the reed switch. The ground conductors are connected to the ground shield on a first side of the reed switch with the signal conductor on one side of the reed switch being positioned between the two ground conductors. Another pair of ground conductors are connected to the ground shield on the other side of the switch and are similarly positioned with the other signal conductor positioned therebetween. The reed switch device is overmolded with encapsulation material with the exception of the free ends of the signal and ground conductors which receive solder balls thereon for surface mount installation to a circuit board. After encapsulation, excess portions of the leadframe are trimmed away.

It is therefore an object of the present invention to provide a compact, low profile reed switch package.

It is an object of the present invention to provide a reed switch device with a controlled impedance environment throughout the entire package.

It is a further object of the present invention to provide a reed switch package with an improved substrate that is stronger and dimensionally more accurate than the existing printed circuit board substrates.

A further object of the present invention is provide a reed switch package that has a substrate that minimizes breakage and distortion during manufacturing.

Another object of the present invention is to provide a reed switch package that is capable of efficiently conducting high frequency signals.

It is a further object of the present invention to provide a reed switch package that is inexpensive to manufacture and more reliable to assemble.

It is yet a further object of the present invention to provide a reed switch package that has solder ball placement that meet coplanarity installation requirements.

Another object of the present invention is to provide a reed switch package that can be easily surface mounted to a main circuit board.

It is yet another object of the invention to provide a reed switch package with a metal substrate that is optimized for high frequency signal transmission.

BRIEF DESCRIPTION OF DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION

Figure 1:
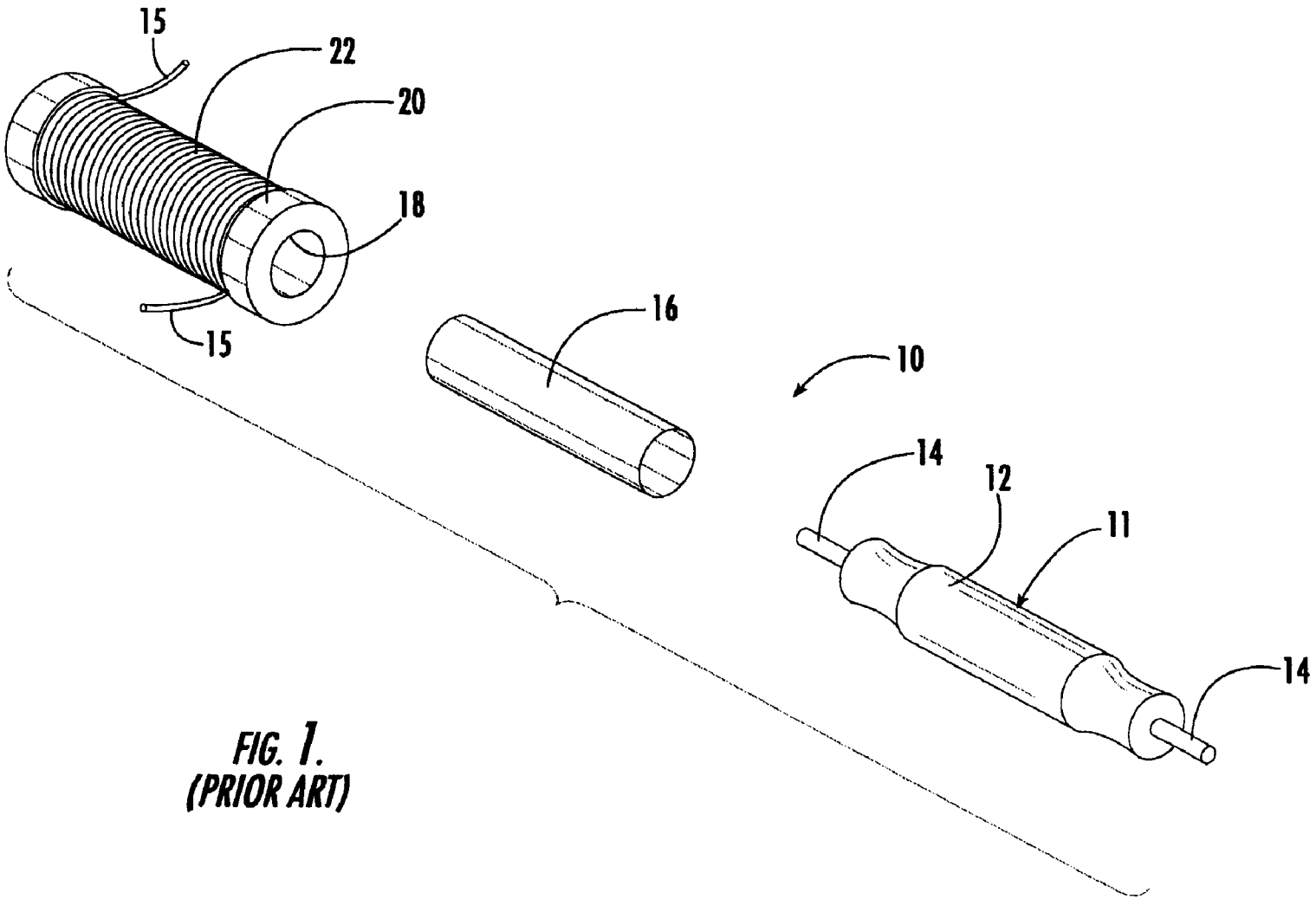
FIG. 1. (PRIOR ART)
FIG. 1 is an exploded perspective view of a prior art reed relay configuration.

Turning first to FIG. 1, a perspective view of a prior art reed switch configuration 10 is shown. A known reed switch 11 includes a glass envelope 12 as well as two signal leads 14 emanating from opposing ends of the reed switch 11 and coil termination leads 15. The construction of a reed switch 11 is so well known in the art, the details thereof need not be discussed. A shield conductor 16, commonly made of brass or copper, is provided in the form of a cylindrical sleeve which receives and houses the reed switch 11. The reed switch 11 and shield 16 are housed within the central bore 18 of a bobbin or spool 20. About the bobbin 20 is wound a conductive wire 22. As a result, a co-axial arrangement is formed to protect the reed switch 11 device and to control the impedance of the environment and to improve the overall transmission of the signal. The reed switch 11, shield conductor 16 and bobbin 20 are shown in general as cylindrical in configuration.

It should be understood that various other configurations, such as those oval in cross-section, may be employed and still be within the scope of the present invention. Also, the reed switch 11 is preferably of the normally open type but may also be of the normally closed type.

As can be understood and known in the prior art, the free ends of the coil of wire 22, the shield 16 and signal terminals 14 of the reed switch 11 are electrically interconnected to a circuit as desired. The respective components of the reed switch 11 configuration are interconnected to a circuit by another electrical interconnection (not shown). The electrical interconnection methods of the prior art introduces a discontinuity of the desirable co-axial environment.

As described above, the overall reed switch device 10 must be designed to be easily accommodated within a user's circuit. For example, a circuit used to operate at high frequency is designed with a defined characteristic impedance environment. The goal of designing and manufacturing a reed device 10 to the specifications of a circuit customer is to match the desired impedance of the device 10 to the circuit environment as closely as possible. It is preferred that there is no discontinuity of impedance from the reed device 10 itself to a circuit board trace of the circuit that will receive the device 10. The characteristic impedance, $Z_1$ is generally a function of the outer diameter of the signal conductor 14, the inner diameter of the shield 16 and the dielectric constant of the insulation (not shown) between the signal conductor 14 and the shield 16.

Figure 2:
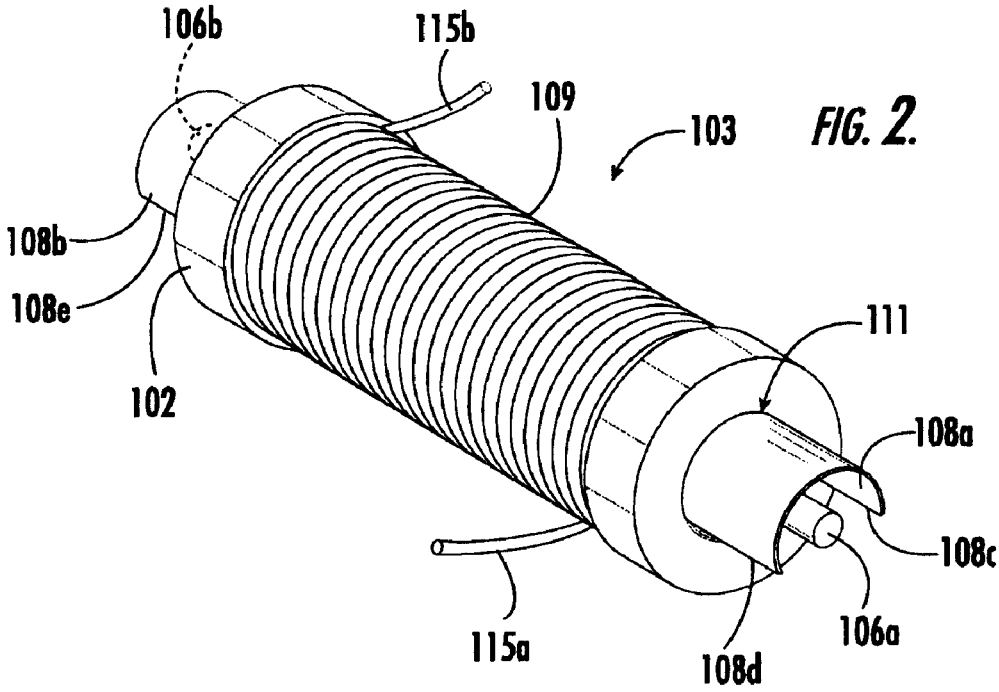
FIG. 2 is perspective view a reed relay device in accordance with the present invention.
Figure 3:
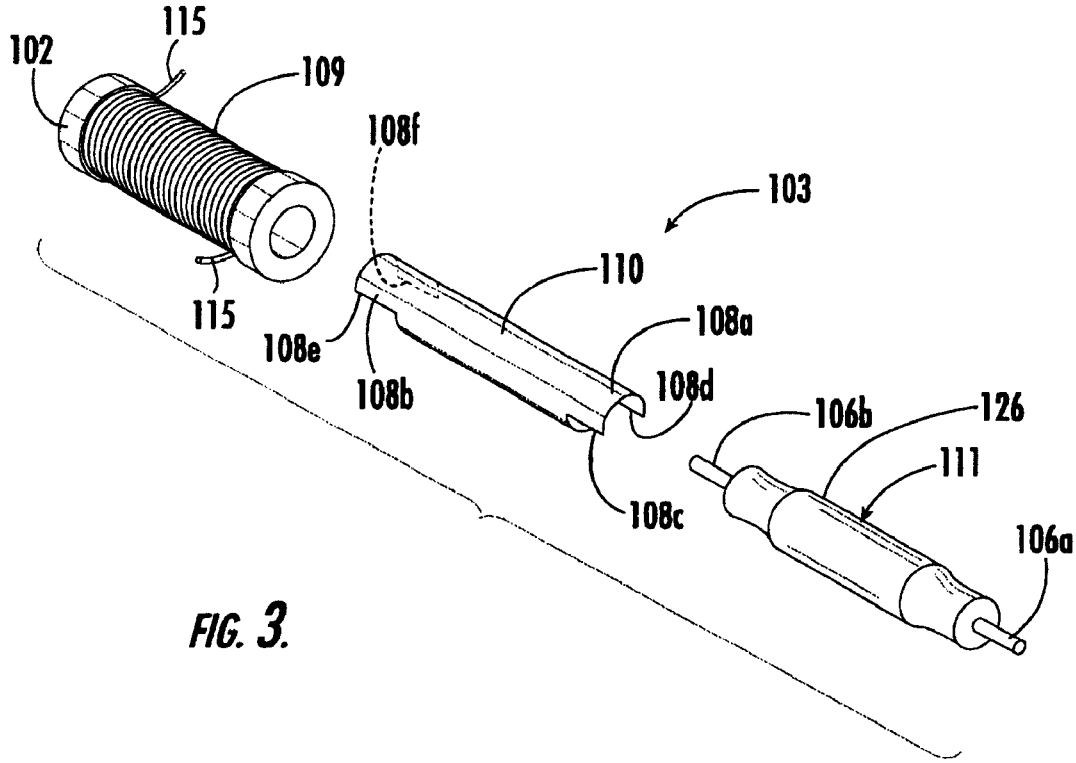
FIG. 3 is an exploded perspective view of the surface mount molded relay of the present invention.

Turning now to FIGS. 2 and 3, the reed switch device 103 used in the package of the preferred embodiment of the present invention is shown. Referring to FIG. 2, the present invention includes a reed switch 111 with a pair of signal terminals 106*a* and 106*b* emanating from opposing sides thereof. A glass envelope 126 is provided with the contact tongues (not shown) therein. Details of the reed switch 111 is not discussed herein as it is well known in the prior art.

The reed device 103 is provided to include an outer bobbin 102 with coil 109, with free ends 115*a* and 115*b*, wrapped around it for introducing the necessary magnetic field to actuate the reed switch 111. Also emanating from the bobbin body 102 are ground shield tabs 108*a* and 108*b* in the form of arcuate semi-circles which are respectively electrically interconnected to opposing sides of the shield sleeve 110. Each of the tabs 108*a* and 108*b* may also be in the form of a pair of tabs extending outwardly from sides of the ground shield sleeve 110. Tab 108*a* is positioned on one side of the bobbin body 102 and tab 108*b* is positioned on the other side of the bobbin body 102. Both tabs 108*a* and 108*b* are electrically interconnected to and emanating from the ends of the inner shield sleeve 110. As shown in FIG. 3, an exploded perspective view the reed switch 111 of FIG. 2, the ground tabs 108*a* and 108*b* are, essentially, an extension from the shield sleeve 110 itself on opposing sides thereof whereby a pair of solderable surfaces 108*b* and 108*d* are provided on the lower edge of the tab 108*a* and a pair of solderable surfaces 108*e* and 108*f*.

Figure 4:
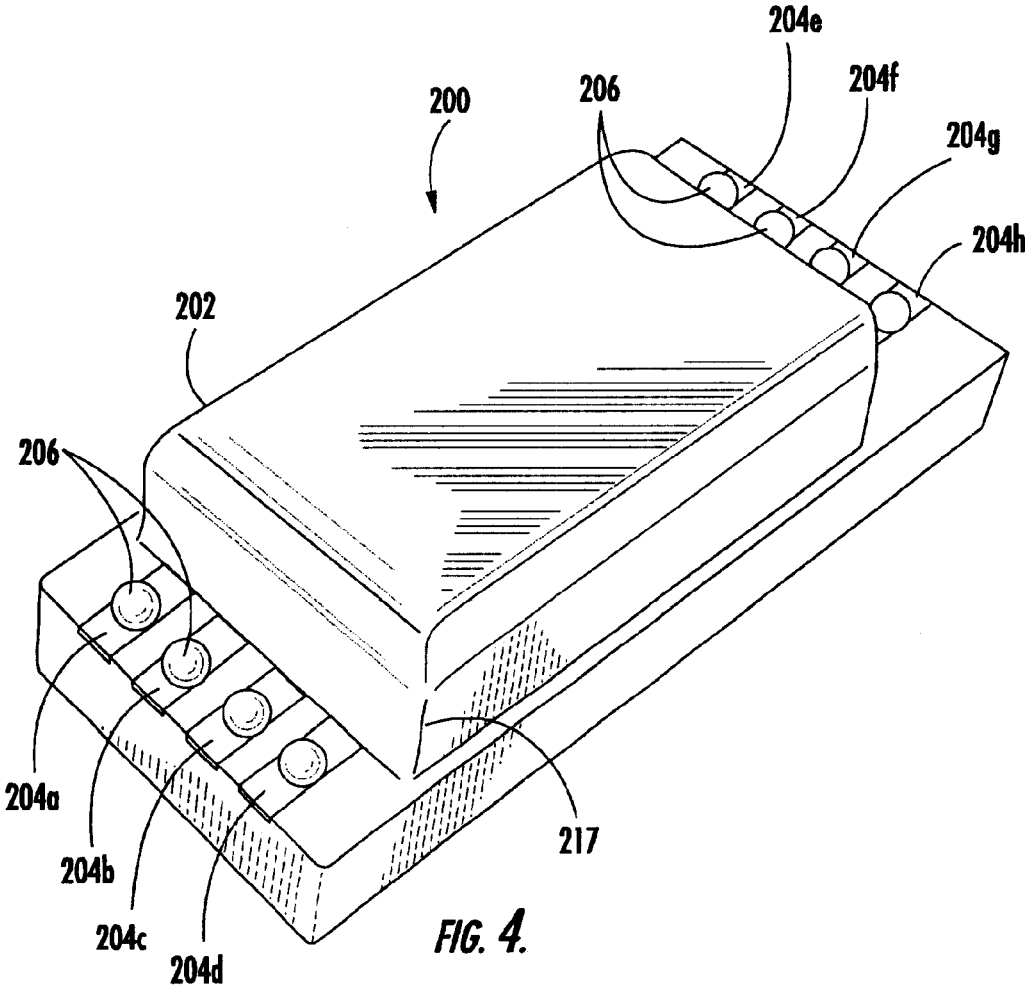
FIG. 4 is a perspective view of the surface mount molded relay package manufactured in accordance with the present invention.

Referring now to FIG. 4, a completed encapsulated reed switch package 200 is shown in accordance with the present invention to include a main body portion 202 and a number of electrical contacts 204*a–h*, which are preferably include solder balls 206 thereon which are affixed to conductors 204*a–h* which are, in turn, connected to the various components of the reed switch package 200. The construction of the conductors 204*a–h* and solder balls 206 thereon will be discussed in detail below. In view of the construction shown in FIG. 4, the reed switch package 200 can be easily surface mounted to a circuit board for incorporation into a circuit (not shown). The surface mounting of reed switch device packages and electrical interconnection to a circuit on a circuit board are so well known in the art that they need not be discussed in detail herein.

Figure 5:
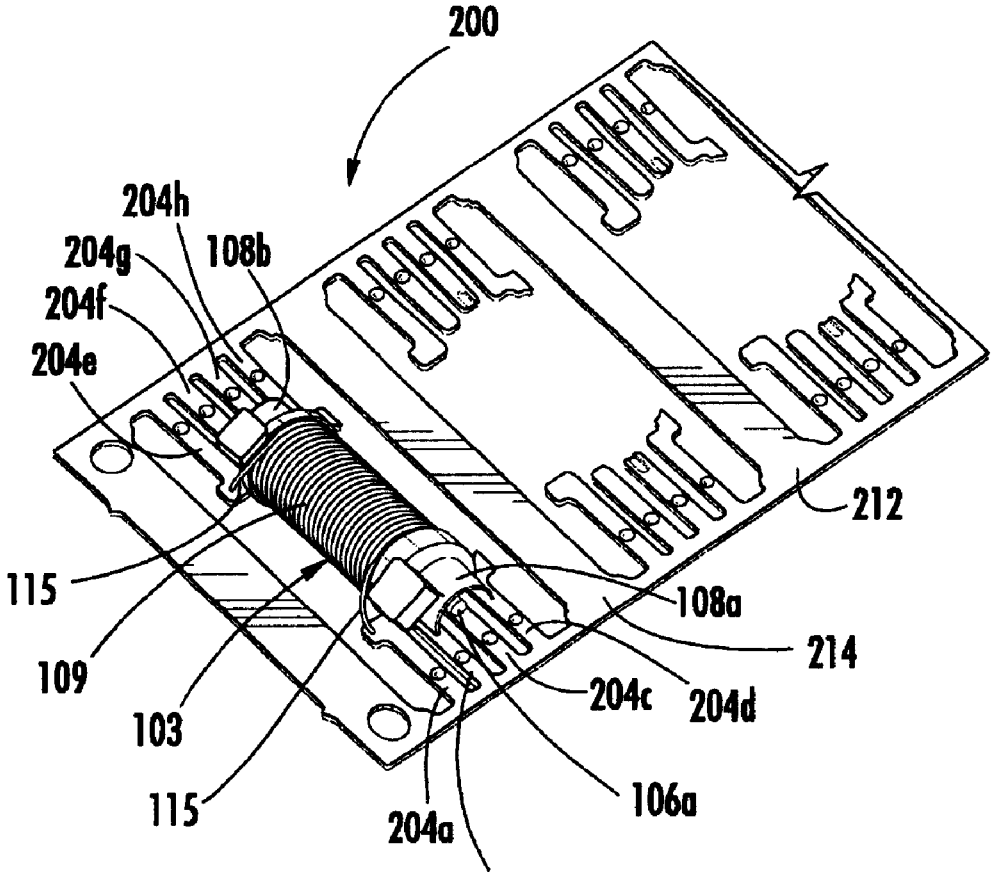
FIG. 5 is a perspective view of the surface mount molded relay package of FIG. 4 prior to encapsulation.

In FIGS. 5–8, details of the construction of the reed switch package 200 of the present invention is shown. Turning to FIG. 5, the reed switch package 200 is shown prior to encapsulation to illustrate the construction and interconnection of the reed switch device 103 to a leadframe substrate 212 to provide a unique surface mountable reed switch device package 200. To facilitate mass manufacture, the leadframe 212 includes an array of sets of conductors 204*a–h* for receiving a number of reed switch devices. For example, an array of 10 leadframe units may be employed for simultaneously manufacturing 10 reed switch device packages 200. For ease of illustration, the first leadframe unit will be discussed in detail.

The leadframe 212 includes an outer carrier frame 214 with a number of conductors 204*a–h* emanating inwardly therefrom for electrical interconnection to various components of the reed switch device 103. The conductors 204*a–h* are employed to provide an interface of the reed switch device 103 to the circuit of the circuit board onto the which the package 200 is installed.

Figure 6:
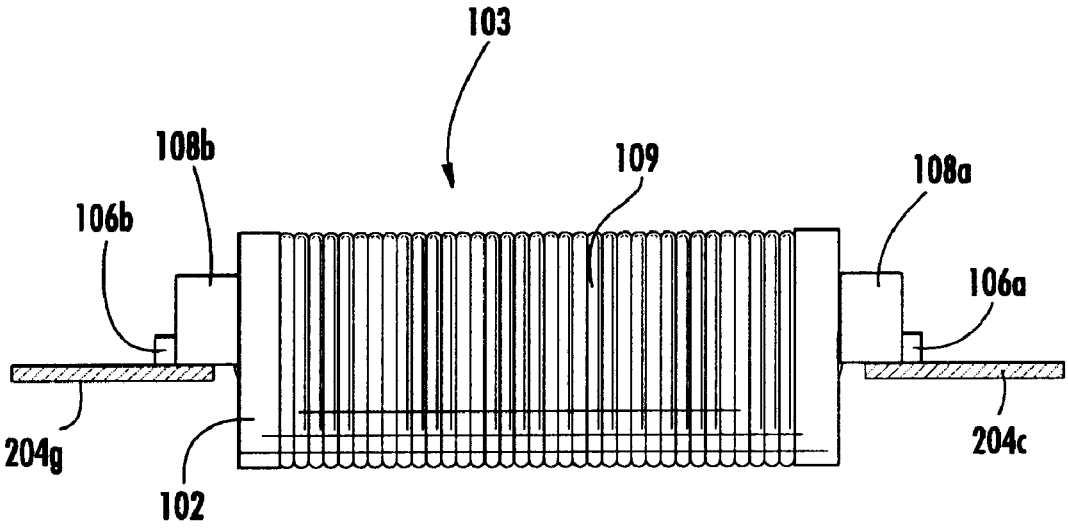
FIG. 6 is a right side elevational view of the reed relay affixed to a leadframe as shown in FIG. 5.

More specifically, on each side of the reed switch device 103, there four electrical interconnections that need to be made for proper operation of the reed switch device 103 within the package 200 and incorporation into a circuit. A signal conductors 204*c* and 204*c* are provided both sides of the reed switch device 103 to respectively interconnect with the signal terminals 106*a* and 106*b*. Also, on the front of the device 103, ground conductors 204*b* and 204*d* are respectively electrically interconnect with the ground shield surfaces 108*c* and 108*d*. On the rear of the device, ground conductors 204*f* and 204*h* are respectively electrically interconnected with the ground shield surfaces 108*e* and 108*f*. Also, the free ends 115*a* and 115*b* or wire coil 109 are respectively electrically interconnected with conductors 204*a* and 204*e*. FIG. 6 further illustrates a right side elevational view of the construction of FIG. 5 where the signal terminals 106*a* and 106*b* are respectively electrically interconnected to their corresponding conductors 204*c* and 204*g*. The foregoing electrical interconnections are preferably made by soldering but could be accomplished by other methods known in the art, such as welding or thermal compression bonding.

The use of a leadframe structure of the present invention, which is optimized for use in an electromechanical switch package, is not found in the prior art. In general, reed relays designed to transmit RF frequencies need special design features. One design difficulty with RF relays is to transition from the internal circular coaxial structure of the reed switch and its shield, to the planar structure needed to affix the relay to an external circuit board. Prior art design approaches was to use a printed circuit board with copper traces formed as striplines. It is well known in RF design that one method to transmit RF signals with minimized power loss is to provide a flat signal conductor flanked on either side by parallel grounded conductors which is an arrangement known as a coplanar waveguide. By adjusting the dimensions of the conductors, the spacing between them and the dielectric constant of the medium in which they sit, it is possible to tune the transmission of the three-conductor stripline combination to a specific characteristic impedance. Conventionally, this impedance is 50 ohms.

Figure 7:
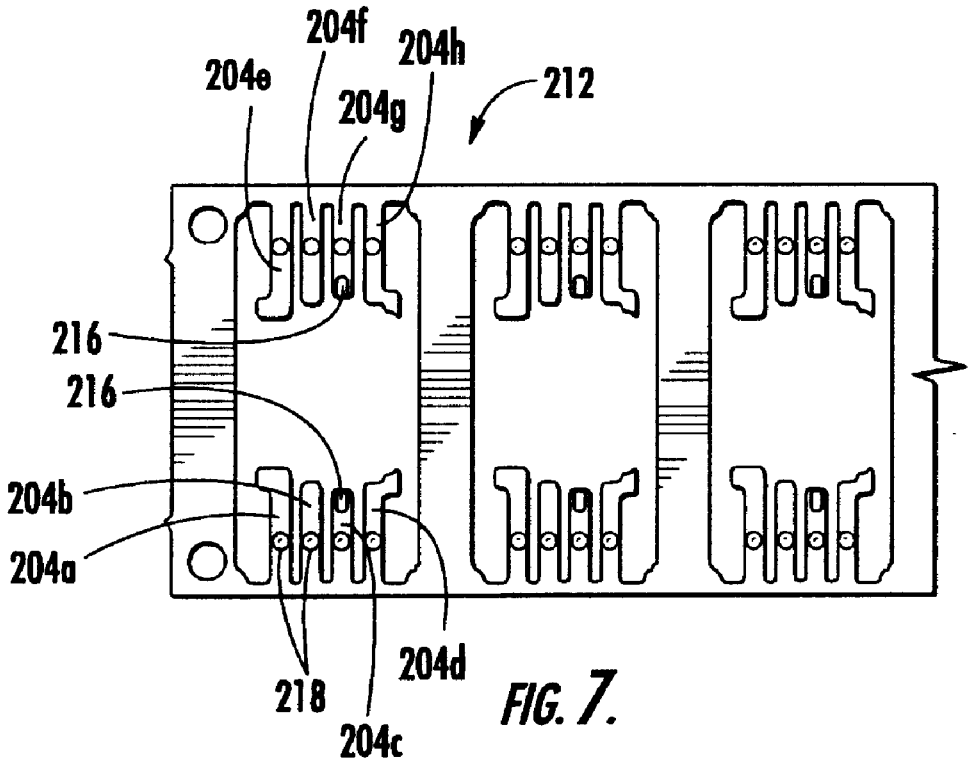
FIG. 7 is a plan view of an array of leadframes prior to installation of reed relays thereon.
Figure 8:
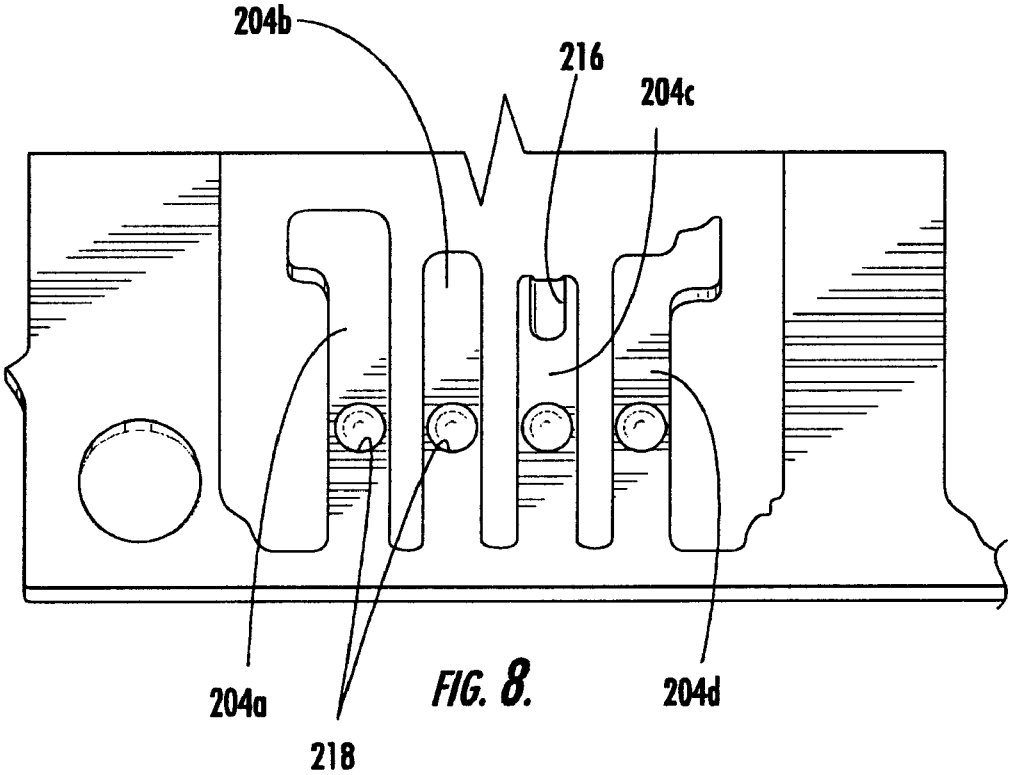
FIG. 8 is a close-up top view of one of the leadframes of FIG. 7.
Figure 9:
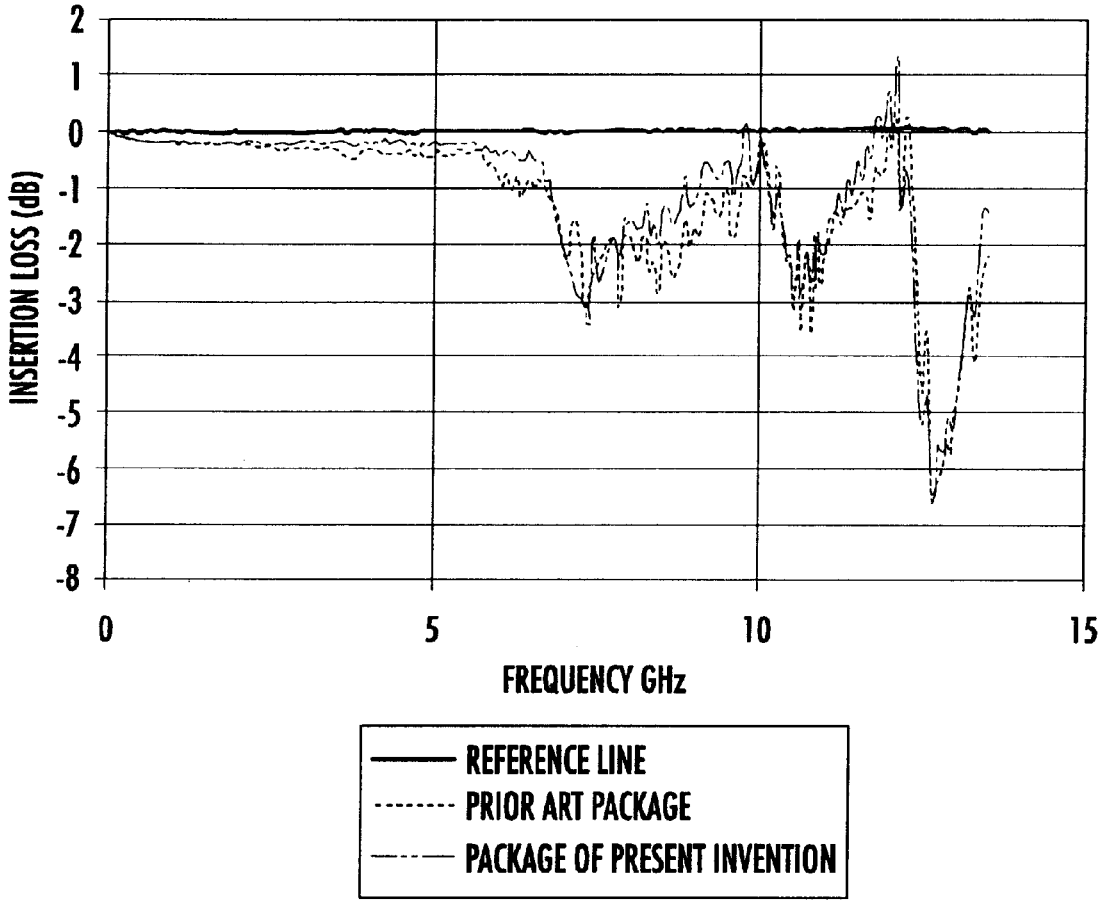
FIG. 9 is a graphical comparison of RF insertion loss of reed relay package with a printed circuit board of the prior art and a relay package manufactured in accordance with the present invention.

The new leadframe structure 212, as best seen in FIGS. 5, 7 and 8, achieves this desirable 50 ohm impedance by using some of the leadframe elements to form a tuned stripline. The leadframe 212 is manufactured so that the elements connecting the reed switch terminals 106*a* and 106*b* and the internal RF ground shield 110 via contact surfaces 108*c–f* to the exterior of the relay form a tuned transmission path with 50 ohm impedance. The dimensions and spacing of the elements are adjusted to match the dielectric constant of the molding compound 217, as seen in FIG. 4, used to encapsulate the reed switch device 103. For example, it has been found that placing the conductors 204*a–h* a distance of 0.45 mm and 0.65 mm in width is conducive to maintaining the desired 50 ohm impedance. After the package 200 is molded, the exterior waste is cropped away, leaving embedded contacts 204*a–h* that allow the package 200 to be surface-mounted to the customer's circuit board. The attachment is preferably made using solder balls 206 but may also be solder bumps, or other interconnection structures, such as land grid arrays (LGA), column grid arrays (CGA) or pin grid arrays (PGA) as well as solder paste dots, raised dimples, and the like.

While the general use of leadframes to create packages are generally known in the art, the present invention achieves the desired 50 ohm impedance by optimizing the leadframe 212 for the high frequency environment. Most importantly, the use of a metal leadframe 212 permits certain materials to be used as conductors 204*a–h* and contacts 206 instead of the printable materials, such as copper, aluminum and tin which are commonly used in printed circuit boards.

In particular, the leadframe 212 is preferably formed from nickel-iron alloy, which can be later plated with other metals to improve the solderability or RF transmission characteristics. Copper may also be used. For example, high conductivity silver plating can be used to improve high frequency transmission, since GHz range signals travel mainly near the skin of a conductor. Moreover, nickel-iron or other magnetically soft material is particularly desirable for the base metal, since it improves the magnetic efficiency and hence reduces the power consumption of the relay. The foregoing optimizations of conductors 204*a–h* cannot be used with printed circuit board based package due to the limitations of the printable copper, aluminum and tin material employed.

Still further, the use of a metal conductors rather than traces on the surface of a printed circuit board provides mechanical advantages as well. Referring now to FIGS. 7 and 8, the mechanical advantages of the metal leadframe 212 are shown more clearly. As seen in FIG. 8, the use of a metal strip lines enables indents 216 to be formed in the interconnection end of the signal conductors 204*c* and 204*g* to form a seat to better receive the signal terminals of the reed switch. The indents 216 are each approximately half as deep as the diameter of switch wire leads 106*a* and 106*b*, and serves as an alignment recess during relay assembly. It also improves RF transmission characteristics, since the high frequency signal travels in a straighter path through the relay. Discontinuities, caused by bends in the path which introduce impedance discontinuities that reduce RF transmission efficiency, are avoided in the package 200 of the present invention.

Still further, as seen in FIG. 8, each of the conductors 204*a–h* of the leadframe 212 also preferably have circular indents 218 formed on the free ends thereof, namely, in the region that is exposed after molding. Solder balls 206, as seen in FIG. 4, are located in these recesses 218, improving their alignment by eliminating wander during attachment. FIG. 4 shows the exposed positioning of the solder balls 206 in the recesses 218 on the free ends of the conductors 204*a–h* in preparation for surface mount installation of the package 200 on a circuit board.

In connection with the construction and assembly of the package 200, the reed switch device 103 is preferably partially assembled before encapsulation. The internal components are soldered to the leadframe 212 using a solder having a high enough melting point to withstand any subsequent manufacturing processes, such as fastening to a customer's circuit board. Typically, 100% tin or 95% tin+5% antimony is used. However, welding or other metal joining processes can be used.

The solder balls 206 have been soldered into the circular recesses 218 in the conductors 204*a–h*. The balls 206 are preferably made from 10% tin+90% lead and have a melting point of 302 degrees C. With such a high melting point, they do not melt at the temperatures used for reflowing the package 200 onto a users circuit board. However, this does not preclude using other types of solder balls 206, such as conventional eutectic solder consisting of 63% tin+37% lead. Nor does it preclude omitting the solder balls 206 altogether, and fastening the package 200 to a user's circuit board using solder paste or other conventional surface mounting techniques.

FIG. 4, as described above, shows the reed switch package 200 of the present invention after encapsulation. The reed switch device 103 is preferably overmolded with typical encapsulation material 217, such as plastic or epoxy material, while still connected to the frame. Complete encapsulation provides an air-tight and/or liquid-tight seal thereby protecting the components therein.

After encapsulation is complete, the surplus leadframe 212 is cropped away, and excess molding flash is removed by routing or sandblasting. As shown in FIG. 4, the truncated leadframe elements, namely conductors 204*a–h* and solder balls 206 thereon, appear as bars embedded in the encapsulant 217 and are ready for surface mount interconnection to a circuit board. The overall height of the reed switch package 200 is greatly reduced thus allowing for a low height installation of components on a circuit board to permit installation into smaller environments and to facilitate closer stacking of populated multiple circuit boards together.

Test data shows that the package 200 of the present invention is an improvement over prior art packages. The chart of FIG. 11 shows the RF insertion loss data for a prior art reed switch package made with an existing printed circuit board compared to the new reed switch package 200 with the metal leadframe 212 of the present invention. The vertical axis represents RF signal power loss in dB, and the horizontal axis represents frequency in GHz. The power loss as a function of frequency is improved for the metal leadframe version up to a frequency of approximately 7 GHz, before both start to roll off to the minimum acceptable level of approximately 3 dB. In view of the foregoing, the new reed switch package 200 of the present invention using a metal leadframe 212 can provide RF transmission performance that is equivalent or better than the existing printed circuit board based designs of the prior art while still providing the advantages listed above.

In view of the foregoing, the present invention provides an improved reed switch device package 200 that includes a metal leadframe substrate 212 that is stronger and dimensionally more accurate than the existing printed board substrates used in prior art packages. The use of a metal leadframe 212 substrate minimizes breakage and distortion during manufacturing, and also ensures that the placement of solder balls 206 meets coplanarity requirements.

The package 200 of the present invention more effectively provides electrical connection conductors 204*a–h* between the exterior of the reed switch device 103 and the internal components by acting as a tuned waveguide with a nominal impedance of 50 ohms and minimum excursions from that impedance, thus minimizing RF power loss in a signal transmitted through the relay. Because the leadframe conductor elements 204*a–h* are dimensionally more accurate than traces plated onto printed circuit boards used in the prior art, the impedance discontinuities are less than those created by a circuit board substrate.

The half-etched switch lead receptacle seats 216 generates a straighter path for signals transmitted through the signal terminals 106*a* and 106 of the switch device 103 thereby reducing impedance discontinuities that can distort RF signals or absorb power. Such recessed seats 216 cannot be formed on traces that have been printed onto a printed circuit board assembly. The recesses 218 for receiving the solder balls 206 further improves alignment during installation.

Eliminating a fibrous circuit board substrate of the prior art improves the overall hermetic sealing of the reed switch device package 200 of the present invention. This reduces the probability of moisture ingress that can lower the device's insulation resistance.

Further, allowing the use of a soft magnetic material such as Nickel/iron (NiFe) alloy for the leadframe substrate 212 improves the magnetic efficiency of the device because it acts as a magnetic antenna. This focuses the field lines generated by the relay coil 109, allowing the reed switch device 103 to be closed with less electrical power than would be needed if copper leads were used. This means that either (a), lower power is needed to close the reed switch 111 or (b) a slightly stronger switch having higher reliability can be closed with the same power. Circuit board traces cannot be easily constructed from NiFe alloy. Even if fabrication method was developed, the limits of magnetic saturation would result in a conductor that was too thin to be useful for boosting magnetic efficiency.

Overall, the package 200 of the present invention reduces manufacturing costs and simplifies assembly and, as a result, achieves a more reliable product.

It would be appreciated by those skilled in the art that various changes and modifications can be made to the illustrated embodiments without departing from the spirit of the present invention. All such modifications and changes are intended to be covered by the appended claims.

What is claimed is:

1. A reed device package, comprising:

a reed switch having a main body and a first side and a second side;

a first signal terminal emanating from the first side of the main body;

a first signal conductor connected to the first signal terminal;

a second signal terminal emanating from the second side of the main body;

a second signal conductor connected to the second signal terminal;

a ground shield surrounding said main body of the reed switch;

a first ground conductor connected to the ground shield on the first side of the reed switch;

a second ground conductor connected to the ground shield on the first side of the reed switch; the first signal conductor being positioned between the first ground conductor and the second ground conductor;

a third ground conductor connected to the ground shield on the second side of the reed switch; and a fourth ground conductor connected to the ground shield on the second side of the reed switch; the second signal conductor being positioned between the third ground conductor and the fourth ground conductor.

2. The reed device package of claim 1, further comprising:

encapsulation material positioned about the reed switch, the first and second signal terminals, the ground shield, the first signal conductor, the second signal conductor, the first ground conductor, the second ground conductor, the third ground conductor and the fourth ground conductor.

3. The reed device package of claim 1, wherein the first signal conductor, the second signal conductor, the first ground conductor, the second ground conductor, the third ground conductor and fourth ground conductor are made of nickel-iron alloy.

4. The reed device package of claim 1, wherein the first signal conductor, the second signal conductor, the first ground conductor, the second ground conductor, the third ground conductor and fourth ground conductor are made of copper.

5. The reed device package of claim 2, wherein the first signal conductor, the second signal conductor, the first ground conductor, the second ground conductor, the third ground conductor and the fourth ground conductor have free ends which do not have encapsulation material thereon.

6. The reed device package of claim 5, wherein the free ends of the first signal conductor, the second signal conductor, the first ground conductor, the second ground conductor, the third ground conductor and the fourth ground conductor have a detent.

7. The reed device package of claim 1, wherein the first signal conductor defines a first signal terminal receiving seat and the second signal conductor defines a second signal terminal receiving seat.

8. The reed device package of claim 1, further comprising:

a bobbin positioned about the reed switch;

a wire coil, having a first free end and a second free end, wrapped around the bobbin;

a first coil conductor connected to the first free end of the wire coil; and a second coil conductor connected to the second free end of the wire coil.

9. The reed device package of claim 8, further comprising:

encapsulation material positioned about the reed switch, the first and second signal terminals, the ground shield, the first signal conductor, the second signal conductor, the first ground conductor, the second ground conductor, the third ground conductor, the fourth ground conductor, the first coil conductor and the second coil conductor.

10. The reed device package of claim 9, wherein the first signal conductor, the second signal conductor, the first ground conductor, the second ground conductor, the third ground conductor, the fourth ground conductor, the first coil conductor and the second coil conductor have free ends which do not have encapsulation material thereon.

11. The reed device package of claim 10, wherein the free ends of the first signal conductor, the second signal conductor, the first ground conductor, the second ground conductor, the third ground conductor, the fourth ground conductor, the first coil conductor and the second coil conductor have a detent.

12. The reed device package of claim 6, further comprising:

a solder ball disposed on each of the detents.

13. The reed device package of claim 11, further comprising:

a solder ball disposed on each of the detents.

14. The reed device package of claim 1, wherein the first signal conductor, first ground conductor and the second ground conductor form a co-planar wave guide.

15. The reed device of claim 1, wherein the second signal conductor, the third ground conductor and the fourth ground conductor form a co-planar wave guide.

16. The reed device of claim 1, wherein the first signal conductor, the second signal conductor, the first ground conductor, the second ground conductor, the third ground conductor and the fourth ground conductor are made of a material selected from the group consisting of nickel-iron alloy and copper.

* * * * *